US005435588A

United States Patent [19]

Commier et al.

[11] Patent Number: 5,435,588

[45] Date of Patent: * Jul. 25, 1995

[54] SKI INCLUDING A BASE AND TWO-PART STIFFENER CONNECTED TO THE BASE

[75] Inventors: Philippe Commier, Annecy; Jacques Le Masson, Cran Gevrier, both of France

[73] Assignee: Salomon S.A., Annecy Cedex, France

[ * ] Notice: The portion of the term of this patent subsequent to Jul. 26, 2011 has been disclaimed.

[21] Appl. No.: 39,582

[22] Filed: Mar. 29, 1993

[30] Foreign Application Priority Data

Apr. 1, 1992 [FR] France ..... 92 04190

[51] Int. Cl.[6] ..... A63C 5/07; A63C 5/075

[52] U.S. Cl. ..... 280/602; 280/607

[58] Field of Search ..... 280/602, 607, 610, 617

[56] References Cited

U.S. PATENT DOCUMENTS

| | | | |
|---|---|---|---|
| 2,258,046 | 10/1941 | Clement | 280/602 |
| 3,260,532 | 7/1966 | Heuvel . | |
| 3,398,968 | 8/1968 | Mutzhas . | |
| 3,937,481 | 2/1976 | Koleda . | |
| 4,568,100 | 2/1986 | Eriksson | 280/602 |
| 4,577,886 | 3/1986 | Chernega | 280/602 |
| 4,697,820 | 10/1987 | Hayashi et al. | 280/602 X |
| 4,848,784 | 7/1989 | Scherubl | 280/602 |
| 4,865,345 | 9/1989 | Piegay | 280/602 |
| 4,896,895 | 1/1990 | Bettosini | 280/607 |
| 4,903,979 | 2/1990 | Dimier | 280/628 |
| 4,974,867 | 12/1990 | Rullier et al. | 280/607 |
| 5,035,442 | 7/1991 | Arnsteiner | 280/602 |
| 5,092,618 | 3/1992 | Mayr | 280/602 |
| 5,156,413 | 10/1992 | Juhasz | 280/602 |
| 5,211,418 | 5/1993 | Scherubl | 280/602 X |
| 5,251,923 | 10/1993 | Stepanek et al. | 280/602 |
| 5,269,555 | 12/1993 | Ruffinengo | 280/602 |
| 5,280,942 | 1/1994 | Ruffinengo | 280/602 |
| 5,332,252 | 7/1994 | Le Masson et al. | 280/607 |

FOREIGN PATENT DOCUMENTS

| | | | |
|---|---|---|---|
| 373786 | 2/1984 | Austria . | |
| 376571 | 12/1984 | Austria . | |
| 0104185 | 3/1983 | European Pat. Off. . | |
| 0409749 | 7/1990 | European Pat. Off. . | |
| 0414387 | 2/1991 | European Pat. Off. . | |
| 0460574 | 12/1991 | European Pat. Off. . | |
| 0492658 | 7/1992 | European Pat. Off. . | |
| 0510308 | 10/1992 | European Pat. Off. | 280/602 |
| 0564767 | 10/1993 | European Pat. Off. . | |
| 1118857 | 6/1956 | France . | |
| 1269049 | 6/1961 | France . | |
| 1407710 | 6/1965 | France . | |
| 1433242 | 2/1966 | France . | |
| 1467141 | 1/1967 | France . | |
| 2433350 | 3/1980 | France . | |
| 2639837 | 6/1990 | France . | |
| 2654636 | 5/1991 | France . | |
| 1578852 | 3/1971 | Germany . | |
| 1603002 | 8/1971 | Germany . | |
| 2135450 | 4/1972 | Germany . | |
| 2259375 | 6/1974 | Germany . | |
| 2833393 | 2/1980 | Germany | 280/602 |
| 3933717 | 4/1990 | Germany . | |
| 363275 | 8/1962 | Switzerland . | |
| WO83/03360 | 10/1983 | WIPO . | |
| WO88/05324 | 7/1988 | WIPO . | |
| WO90/03205 | 4/1990 | WIPO . | |

*Primary Examiner*—Margaret A. Focarino
*Assistant Examiner*—Peter C. English
*Attorney, Agent, or Firm*—Sandler, Greenblum & Bernstein

[57] ABSTRACT

A ski including a first sub-assembly or base having its own distribution of stiffness and a second upper sub-assembly or stiffener connected to the base by means of flexible and/or partially rigid connections. The stiffener includes two parts separated and spaced from one another by a short distance when the ski is at rest. The two parts cooperate with each other when the ski is biased flexionally in certain functional conditions so as to increase the stiffness of the ski.

67 Claims, 13 Drawing Sheets

21
5
SEE FIG. 13a
1
20

21
5
d
22
20
1

21
5
20
1

F
21
SEE FIG. 14a
20
1

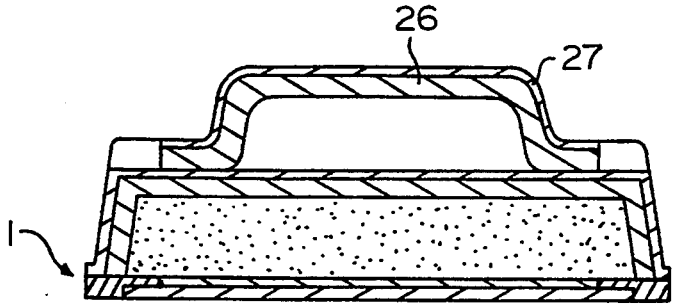
FIG. 24
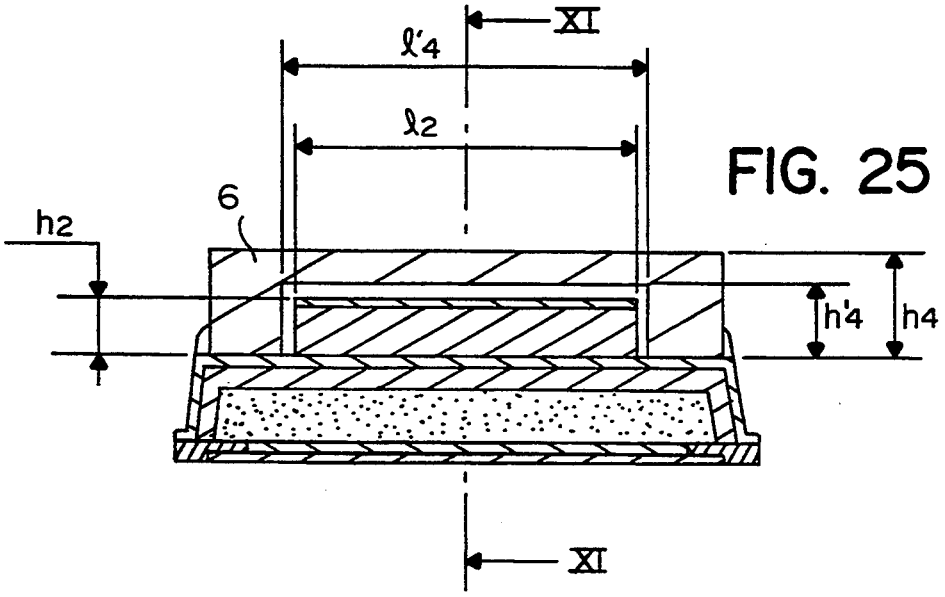
FIG. 25
FIG. 26
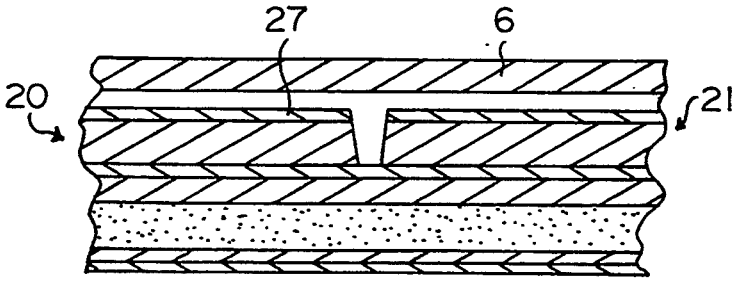

SKI INCLUDING A BASE AND TWO-PART STIFFENER CONNECTED TO THE BASE

BACKGROUND OF THE INVENTION

1. Field of the Invention

The present invention is related to a ski, especially an alpine ski. It is especially related to an improvement to this type of ski.

2. Discussion of Background and Relevant Information

Various types of skis, and numerous variations thereof are already known. These skis are constituted by an elongate beam whose front end is curved upwardly to constitute a shovel, the rear end also being curved slightly to constitute the heel.

Current skis generally have a composite structure in which different materials are combined so that each of them cooperate optimally, taking into account the distribution of mechanical stresses during skiing. Thus, the structure generally comprises peripheral protection elements, internal resistance elements to resist the flexional and torsional stresses, and a core. These elements are assembled by adhesion or by injection, the assembly generally being undertaken in a hot mold having the definitive shape of the ski, with a front portion substantially raised in a shovel, a rear portion slightly raised in a heel and a central arched portion.

Despite the concern of ski manufacturers to manufacture good quality skis, they have not, until now, found a high performance ski that is satisfactory in all conditions of use.

Current skis have a certain stiffness, which is a value that increases substantially in a linear fashion in accordance with the flexional forces applied on the ski, such forces appearing during use of the ski on snow. Under difficult skiing conditions, at high speeds and over very undulating terrain or on hard snow, the stiffness of some skis, adapted to average skiers, is sometimes insufficient for the skier to maintain adequate contact with the snow.

On the contrary, skis adapted to advanced skiers are generally much stiffer and respond much quicker to flexional biases, especially at high speeds and on bumpy slopes and difficult snow conditions. However, in other conditions, especially in very undulating areas requiring passage at average speeds, their excessive stiffness adversely affects easy skiing and good mobility of the ski.

SUMMARY OF THE INVENTION

An object of the present invention is to provide an improved ski not afflicted with the aforementioned disadvantages. The improvements brought by the invention confer satisfactory behavior under all conditions of use, even the most extreme conditions to the ski.

To this end, the ski of the invention comprises a first lower sub-assembly or base whose front end is raised to form the shovel, and a second upper sub-assembly or stiffener. The upper sub-assembly comprises two separate portions connected to the first lower sub-assembly by a flexible and/or partially rigid connection. The two portions are constituted by two beams, substantially aligned along the longitudinal axis 1—1' of the ski, and are spaced from one another by a very short distance d when the ski is in the resting position; these portions cooperate with each other when the ski is flexionally biased under certain functional conditions so as to increase the stiffness of the ski.

According to an advantageous arrangement, the two-part stiffener has a length comprised between 50 and 80% smaller of the length of the surface of the base in contact with the snow. According to an embodiment, the front and rear portions are partially connected to the base by rigid connections.

According to another embodiment, the front and rear portions are completely connected to the base, each by a flexible connection.

According to a variation of the invention, the two portions of the stiffener are connected by a shock absorption device.

Finally, according to another advantageous variation, the free space between the two portions of the stiffener can be completely or partially occupied by an elastic system, such as a spring.

BRIEF DESCRIPTION OF THE DRAWINGS

Other characteristics and advantages of the invention will become more apparent upon reading the description that follows with reference to the annexed drawings, which are provided as non-limiting examples only.

FIG. 24 is a section along IX—IX of FIG. 23;

FIG. 25 is a section along X—X of FIG. 23;

FIG. 26 is a sectional view along XI—XI of the view of FIG. 25;

DETAILED DESCRIPTION OF THE PREFERRED EMBODIMENTS

Figure 1:
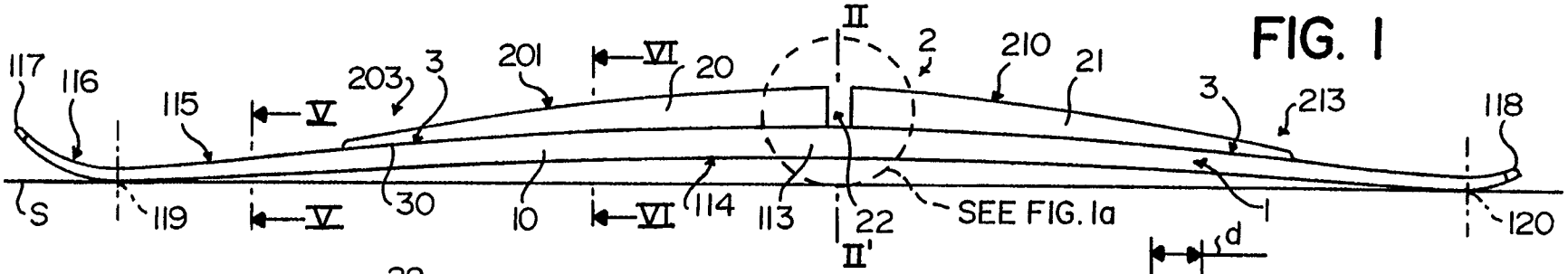
FIG. 1 is a side elevation view of a first embodiment of a ski of the invention.
Figure 1A:
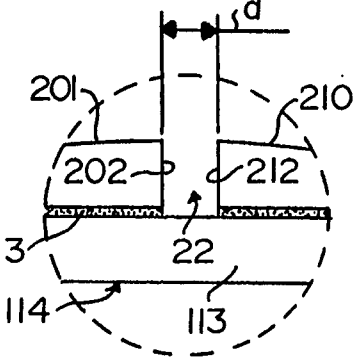
FIG. 1*a* is a detailed view of FIG. 1.

The ski as per the invention, as shown in FIG. 1 according to a first embodiment, comprises a lower sub-assembly or base 1 and an upper sub-assembly or stiffener 2.

The stiffener is constituted by a first front portion 20 and a second rear portion 21. The two front 20 and rear 21 portions extend longitudinally and are separated from one another. They each have an upper surface 201, 210 spaced from each other, by a short distance d so as to arrange a clearance 22 between each part 20, 21. Each part 20, 21 is connected to the base by connection means 3.

Figure 2A:
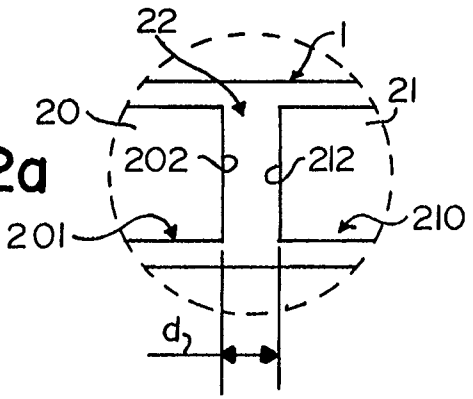
FIG. 2*a* is a detailed view of FIG. 2.
Figure 2:
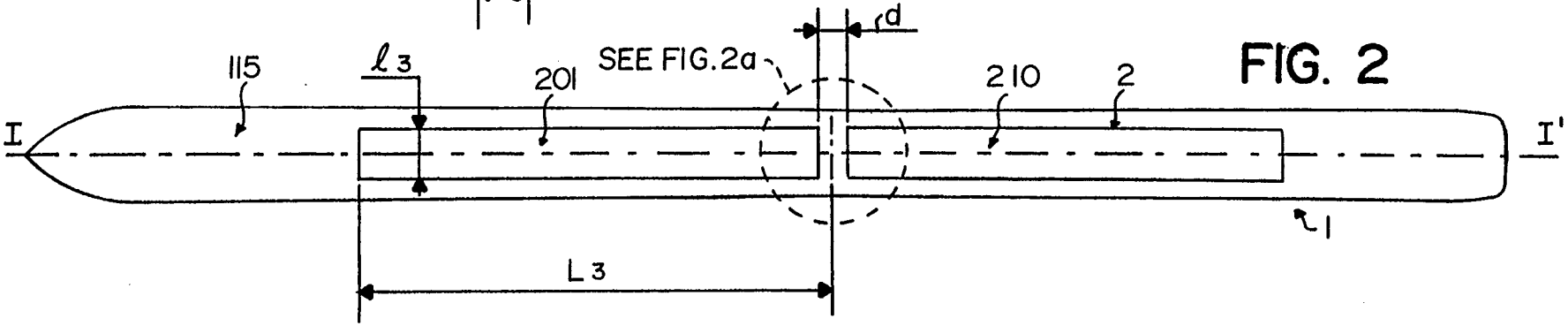
FIG. 2 is a top plan view of the ski of FIG. 1.

As is shown in FIG. 2, portions 20, 21 of the stiffener are aligned along the median longitudinal axis I—I′ of the ski. In the example described, the two portions comprise two identical beams symmetrical with respect to the median vertical axis II—II′. But naturally, this characteristic is not indispensable to the invention.

Base 1 is the element in contact with the snow and is presented in the form of an elongate beam 10 having its own distribution of thickness, width and therefore its own stiffness. This elongate beam can have a stiffness that is less than or equal to that of a traditional ski. Base 1 comprises a central portion 113 slightly arched, having a lower sliding surface 114 and an upper surface 115. The central portion 113 occupies the greater portion of the length of the base and extends, on the one hand, frontwardly by a front portion 116 raised to form the shovel 117, and on the other hand, by a rear portion 118 slightly raised to form the heel of the ski. The rear portion 118 being of a relatively smaller length and being less raised, whereas the front portion 116 is longer and much more arched, as is known and represented in the drawings.

When the ski is not subject to the weight of the skier, its lower surface is in contact with the ground S along a front contact line 119 and a rear contact line 120. The central portion 113 is measured between the front 119 and rear 120 lines of contact.

According to the invention, the upper surface 115 of the central portion 113 of base 1 is covered by a stiffener 2 made of two parts. This element is adapted to complete the distribution of stiffness of base 1 so as to obtain the desired overall distribution. The stiffener 2 can be of any type, of any shape, and of any structure.

As described previously, there is a clearance 22 between the two parts, 201, 210 of stiffener 2 when the ski is at rest; i.e., when no flexional bias is applied on it.

Figure 3:
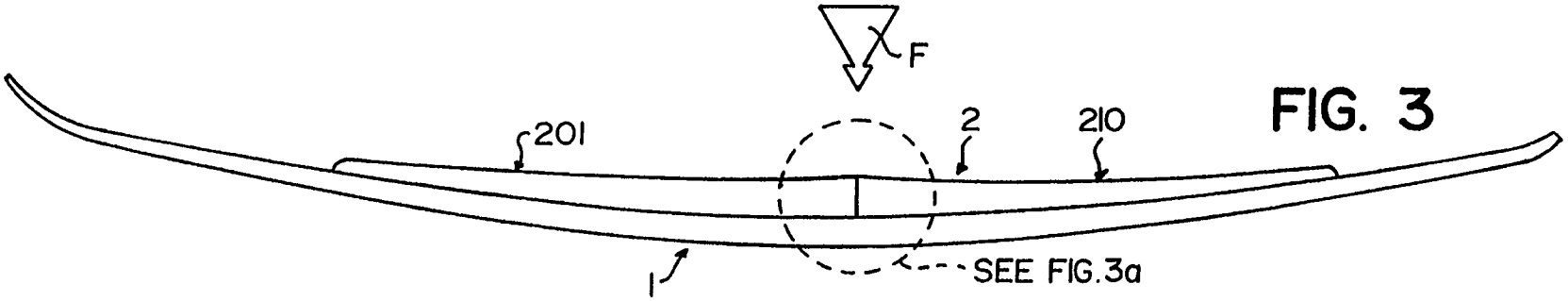
FIG. 3 is a side elevation view of the ski of the embodiments of FIGS. 1 to 2*a* showing the principle of functioning during application of a flexional bias.
Figure 3A:
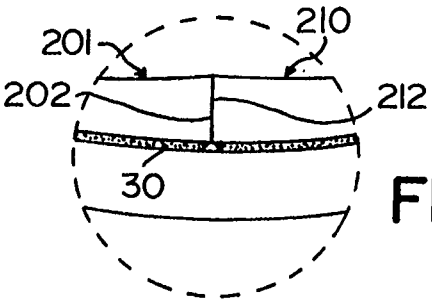
FIG. 3*a* is a detailed view of FIG. 3.

As can be seen in FIGS. 3 and 3*a*, application of a flexional force in the downward direction decreases distance d or clearance 22 created between the two surfaces 201, 210 of the stiffener parts creating a support of the two surfaces 202, 212 of the two parts of the stiffener and thus increasing the stiffness of the ski.

By varying the amount of clearance created between the two parts, one can prepone or postpone the effect of the stiffener on the base.

Figure 4:
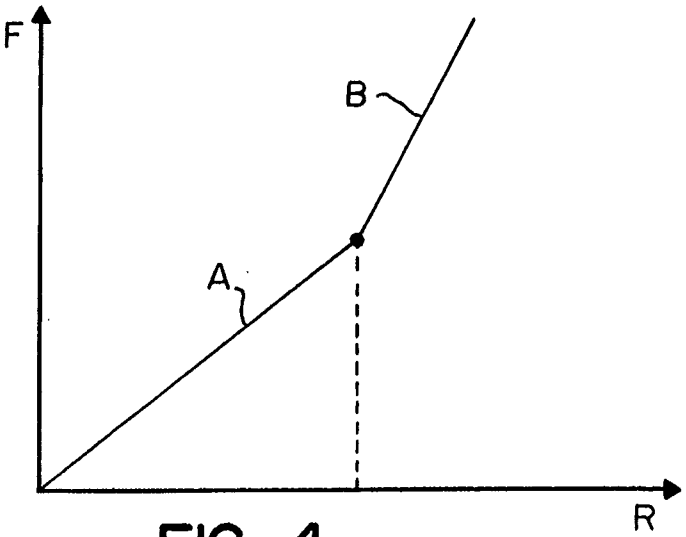
FIG. 4 shows, in a diagram, the variation of stiffness of the ski, in accordance with flexion, for the embodiment of FIGS. 1–3.

The curve of FIG. 4 shows the speed of change of the stiffness R of the ski in accordance with the increase of flexional force F applied on the ski. Portion A of the curve corresponds to the application of force values below the minimal input value in accordance with the stiffener. The stiffness of the ski is therefore determined by the stiffness of the base.

Part B corresponds to the functional range of the stiffener, translating into an increase of the slope of the curve due to the addition of stiffness by the stiffener.

Figure 5:
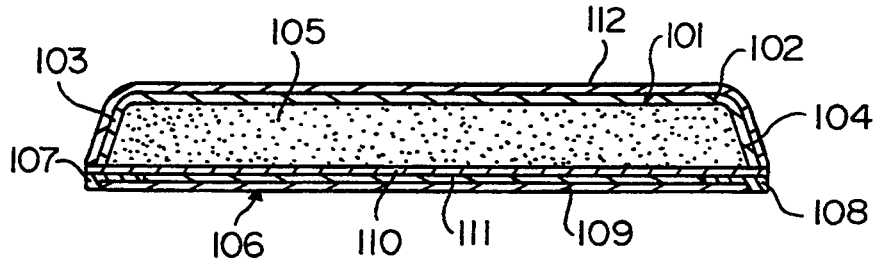
FIG. 5 is a transverse section of the ski along V—V of FIG. 1.
Figure 6:
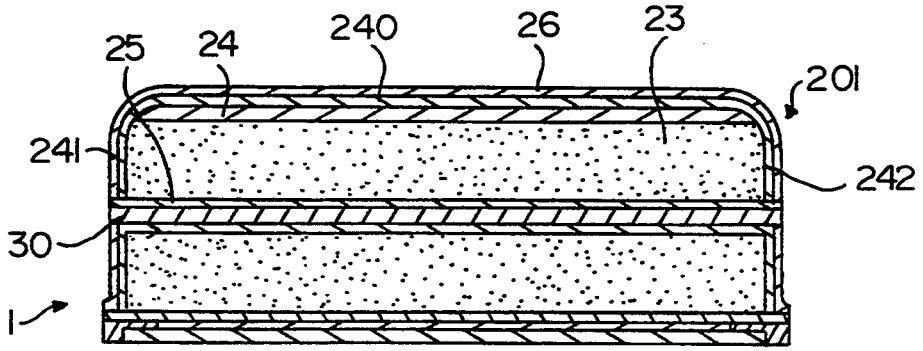
FIG. 6 is a transverse section of the ski along VI—VI of FIG. 1.

FIGS. 5 and 6 show an example of the structure of the ski according to the invention.

The structure of base 1 can be of the sandwich type or the box type or any other type. In FIG. 5, a preferred structure is represented comprising an upper reinforcement 101 which is rigid and in the shape of a shell having a "U" shaped section forming an upper wall 102 and two lateral walls 103 and 104 covering a core 105, the assembly being closed at its lower portion by a lower element 106 comprising metallic running edges 107, 108 a sliding layer 109 generally made of polyethylene, as well as lower reinforcement elements 110, 111. An upper superficial layer 112 covers the upper reinforcement to form the decor of the base.

The reinforcement layers 101, 110, 111 can be of any types such as layers of composite material, such as fiberglass, carbon fiber with epoxy resin or polyester, or even a metal alloy.

The core 105 can be of foam, reinforced or not, of wood or an aluminum honeycomb.

The superficial layer ensuring the decor can be made of a thermoplastic material, such as polyamide. It can be a single layer structure, or be constituted of several layers.

In the embodiment provided as an example and represented in FIG. 6, the structure of each part 20, 21 of the stiffener is of the box-type and is formed by a core 23 located between an upper reinforcement 24 and a lower reinforcement 25.

Naturally, the structure can be of the sandwich-type, i.e., it can be constituted by a stacking of different elements such as reinforcements and cores. The stiffener 2 can also be constituted by a simple section shaped like an "omega" (Ω) for example. In this case, the stiffener can be obtained in a composite material by the TRE (Stampable Reinforced Thermoplastic) technique or SMC (Sheet Molding Compound) for example.

The upper reinforcement 24 is covered by another additional reinforcement layer 240 shaped like an inverted "U" forming an upper wall and two lateral walls 241, 242. A superficial layer 26 covers the top and the lateral surfaces of the stiffener 2 to form the finishing and decor thereof.

As previously described for the base, the reinforcement layers of the stiffener can be of any type, such as layers of composite materials like fiberglass, carbon fiber, with epoxy resin or polyester or even metallic or fiber-metallic reinforcements. Core 23 can be of foam, reinforced or not, of wood or an aluminum honeycomb. The superficial layer ensuring the decor can be made of polyamide, for example, and be single-layered or multi-layered.

According to the invention, the stiffener 2 parts are connected to base 1 by connection means 3 such that the connection between the two elements is flexible and/or partially rigid.

The embodiment of FIGS. 1–6 represents an example according to which, the connections 3 between the base 1 and parts 20, 21 of stiffener 2 assemblies are entirely flexible. To this end, connection means 3 are obtained by a flexible interface 30 located between base 1 and the entire length of each part 20, 21 of stiffener 2. The interface beneath each part 20, 21 has a width l3 equal to that of each portion and a length L3 equal to the length of each part of the stiffener. When flexional force is applied on the ski, the stiffener parts come closer together, and the interface is deformed by a shearing effect as is shown in FIG. 3*a*.

Interface 30 is obtained by a layer of a flexible material of an elastic type, and especially of a viscoelastic type, having a thickness of 0.1 to 5 millimeters, which is adhered or welded, on the one hand, on the upper surface 115 of base 1 and on the other hand, beneath the lower surface of the stiffener. The material used can be elastic having a Shore hardness A of 10 to 85, or a viscoelastic material having an elasticity modulus of 15 to 160 megapascals, or a Shore hardness A of 50 to 95 and a shock absorption value of 0.13 to 0.72. Naturally, this data is non-exhaustive and is provided for a temperature of 20° C. and at a frequency of 15 hz.

The fixing of interface 30 on base 1 and stiffener 2 is obtained either by a thermohardenable resin of the polyester epoxy, vinyl ester or polyurethane type, or a thermoplastic film such as polyamide, or any other means.

Figure 7:
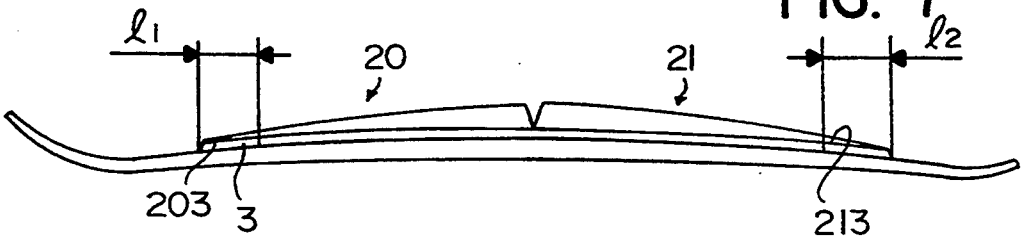
FIG. 7 shows a transverse, schematic view of the partial connections of the stiffener parts on the base.
Figure 8:
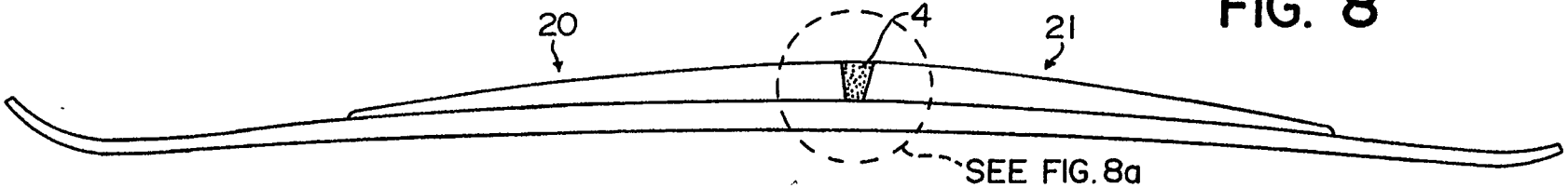
FIG. 8 is a transverse view of another embodiment than the one showed in FIG. 1.

Other types of connections can be envisioned, such as those illustrated in FIGS. 7 and 8. In FIG. 7, the connection between each portion 20, 21 is partial and obtained at the front and rear ends of the stiffener. The front part 20 of the stiffener is connected by its front end 203 along a length l1. Similarly, the rear part 21 is connected by its rear end 213 along a length l2. The connections 3 in the present case are flexible and obtained by two flexible interfaces.

According to other variations, connection 3 between base 1 and each part of stiffener 2 is partially rigid. That is, when rigid, the connection does not extend beneath the entire surface of stiffener 2 so as to enable, specifically, the stiffener parts to come closer together with respect to each other.

The rigid connection 3 can be obtained by any means such as adhesion, mechanical connection, such as screws or rivets or even by welding, especially by ultrasound or vibration welding.

Naturally, connection 3 between base 1 and its stiffener 2 can be mixed, i.e., partially flexible and partially rigid.

Figure 8A:
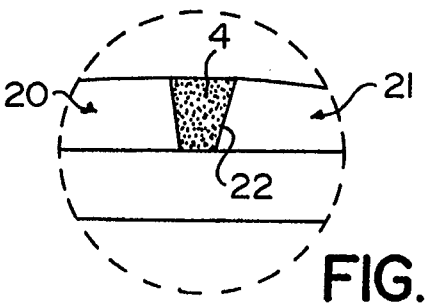
FIG. 8*a* is a detail of FIG. 8.

FIGS. 8 and 8*a* show an interesting variation of the invention in which a shock absorption device 4 connects the two parts 20, 21 of the stiffener. The space or clearance 22 between the two parts 20, 21 when the ski is in the resting position, is occupied by a pad made of a viscoelastic material having shock absorbing properties. Thus, the pad is compressed as the ski is biased flexionally. It is preferably maintained in place by adhesion against surfaces 202, 212 of the front and rear parts of the stiffener.

Figure 9:
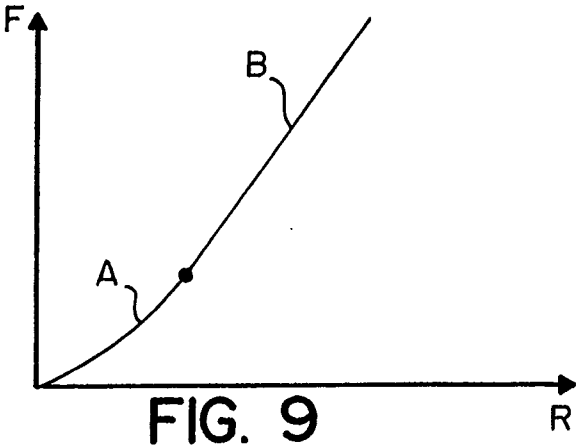
FIG. 9 is the diagram of the variation of stiffness in accordance with the flexion of the ski of FIGS. 8 and 8*a;*

FIG. 9 shows the stiffness variation curve in accordance with the flexional force applied. The first part A of the curve illustrates the compression range of pad 4. The stiffness no longer varies in a linear manner, according to the flexion applied, but in a progressive manner. Part B illustrates the range of non-compressibility of pad 4. In this case, the stiffness varies in a linear fashion in accordance with the biases applied. By shock absorption device, one can also provide any type of device such as hydraulic or gas compression for example.

Figure 10:
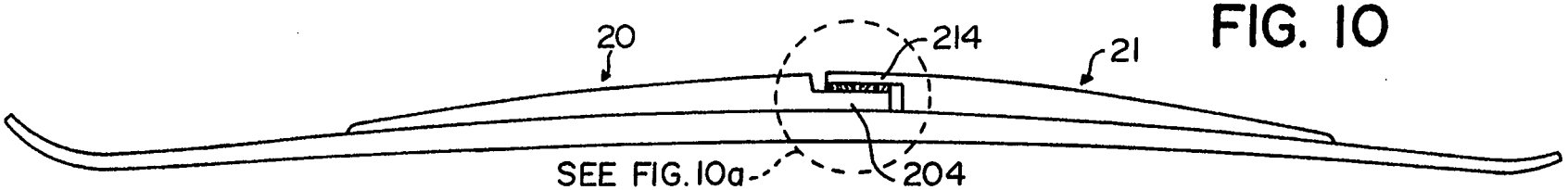
FIG. 10 is a transverse view of another variation.
Figure 10A:
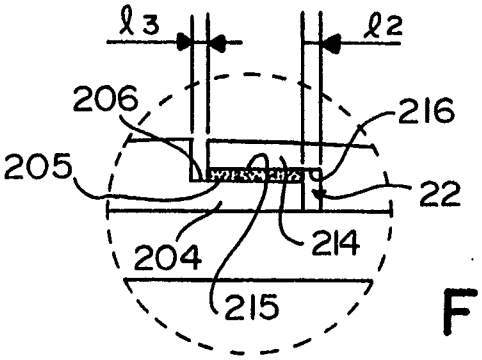
FIG. 10*a* is a detail of FIG. 10.
Figure 11:
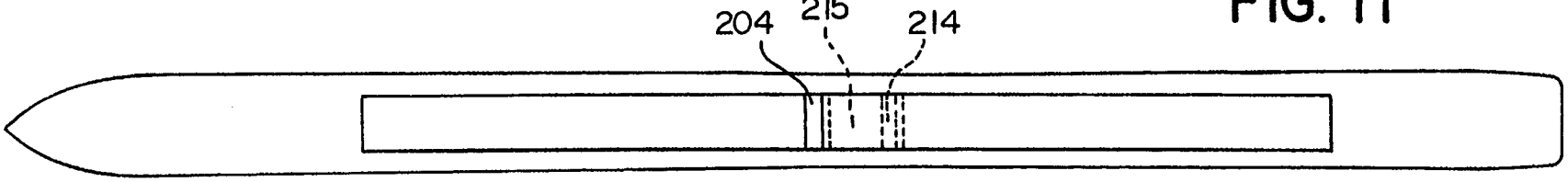
FIG. 11 is a top view of the ski of FIGS. 10 and 10*a;*

FIGS. 10–11 show a variation of FIGS. 8 and 8*a* in which the shock absorption occurs by shearing of a pad made of a viscoelastic material connecting a first part 205 of the upper surface of one of parts 20 to a second part 215 of the lower surface of the other part 21.

Figure 12:
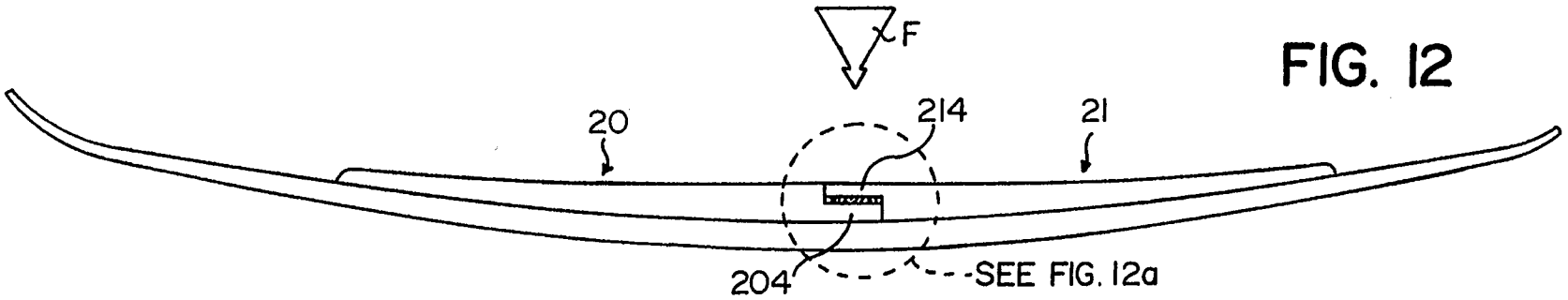
FIG. 12 shows the ski of FIGS. 10–11 during flexional bias.
Figure 12A:
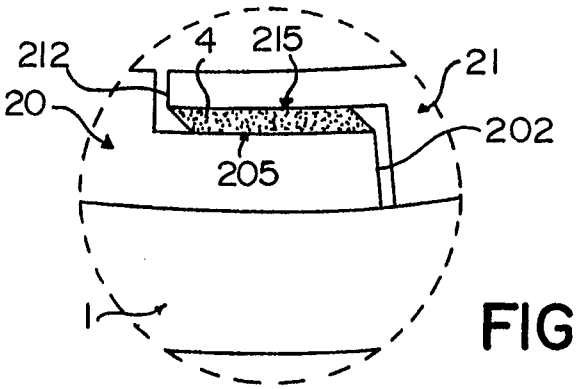
FIG. 12*a* shows a detail of FIG. 12.

The portions of surfaces 205, 215 connected to each other each constitute the horizontal surface of a recess 206, 216 obtained in each part 20, 21 of the stiffener. The recesses 206, 216 enable a complementary nesting of ends 204, 214 of the stiffener parts when the ski is biased in flexion as can be seen in FIGS. 12 and 12*a*. The shock absorption effect can be limited to avoid a potential tearing away of pad 4 by the contact of surfaces 202, 212 of ends 205, 215 of parts 20, 21 of the stiffener.

Figures 13, 13A, 14, 14A:
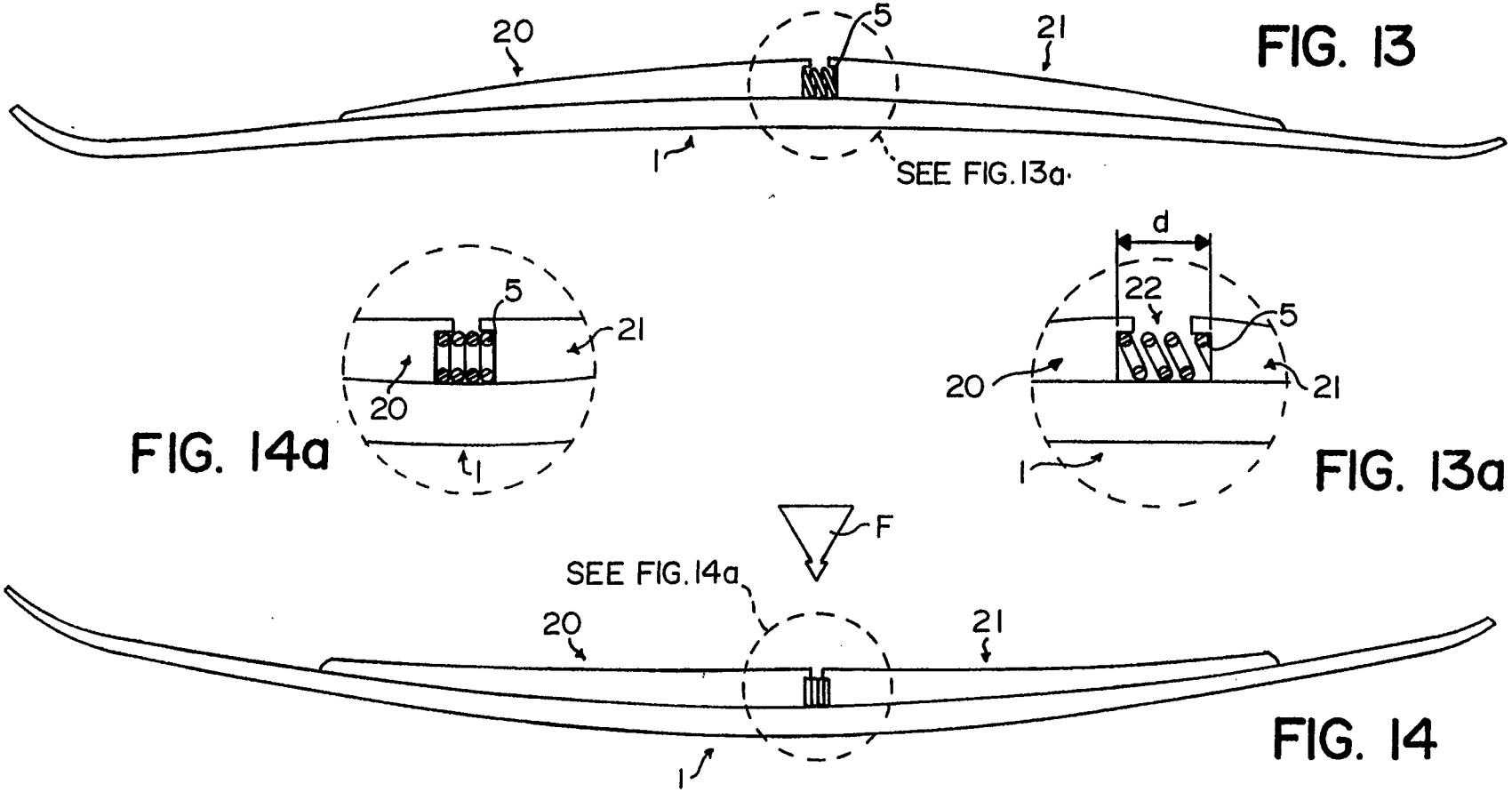
FIG. 13 is a side elevation view of another variation of a ski according to the invention.
FIG. 13*a* is a detail of FIG. 13.
FIG. 14 shows the ski of FIGS. 13, 13*a* during flexional bias.
FIG. 14*a* is a detail of FIG. 14.
Figure 15:
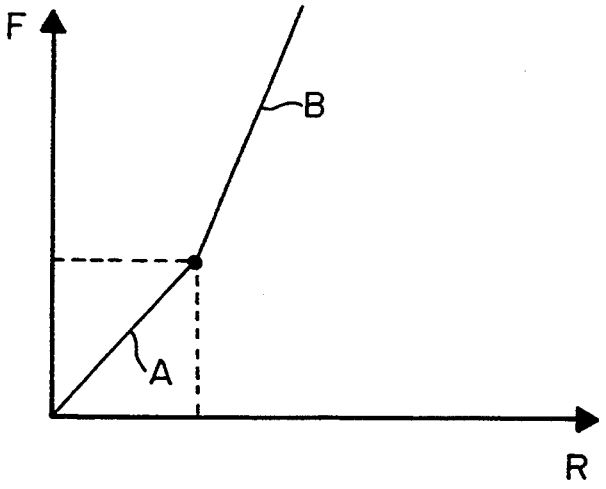
FIG. 15 is the diagram of the variation of stiffness in accordance with the flexion of the ski of FIGS. 13–14.
Figure 16:
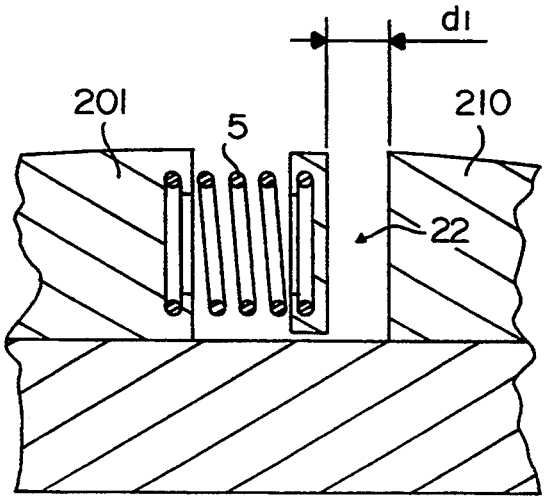
FIG. 16 is a detailed view of a variation of the view of FIG. 13*a;*

FIGS. 13–15 illustrate another variation of the invention whereby the space or clearance 22 created between the two parts 20, 21 is occupied by an energizing system 5 providing an elastic return force to the flexional biases of the ski. As an example, the system can be an elastic system, especially a spring. The flexional forces of the ski are constituted by a coming together of the two parts 20, 21 of the stiffener with respect to each other, that compress spring 5 and create a return force proportionate to the flexional force exerted as is shown in the first part A of the curve of FIG. 15. The second part B shows the effect brought by the stiffener when the end of the path of spring 5 is attained FIG. 14*a*.

Figure 17:
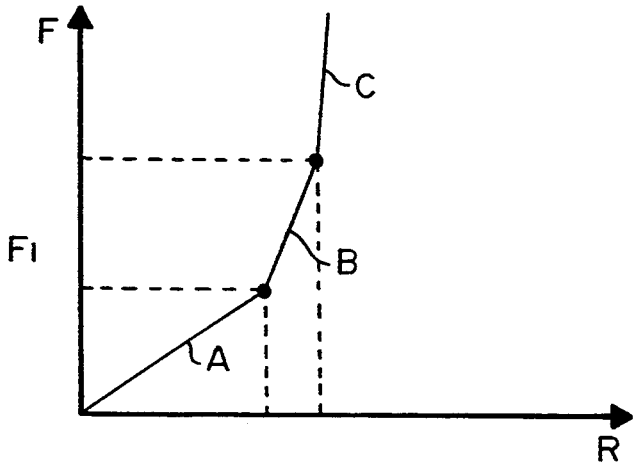
FIG. 17 illustrates the diagram related to the variation of FIG. 16.

One can also provide that the energizing system 5 only partially occupies clearance 22 separating the two parts of the stiffener. In this case, system 5 is affixed to end 201 of one of the parts. Thus, a clearance 22 is provided between system 5 and end 210 of the other part that enables a functioning of an energizing system 5 only from a flexional value F1 of the determined ski as shown in FIG. 17.

Other elastic systems can be provided, and those described are not exhaustive. Thus, one can interpose between the two parts of the stiffener, a system having several serial springs with different stiffnesses, for example.

Figures 18, 19, 20:
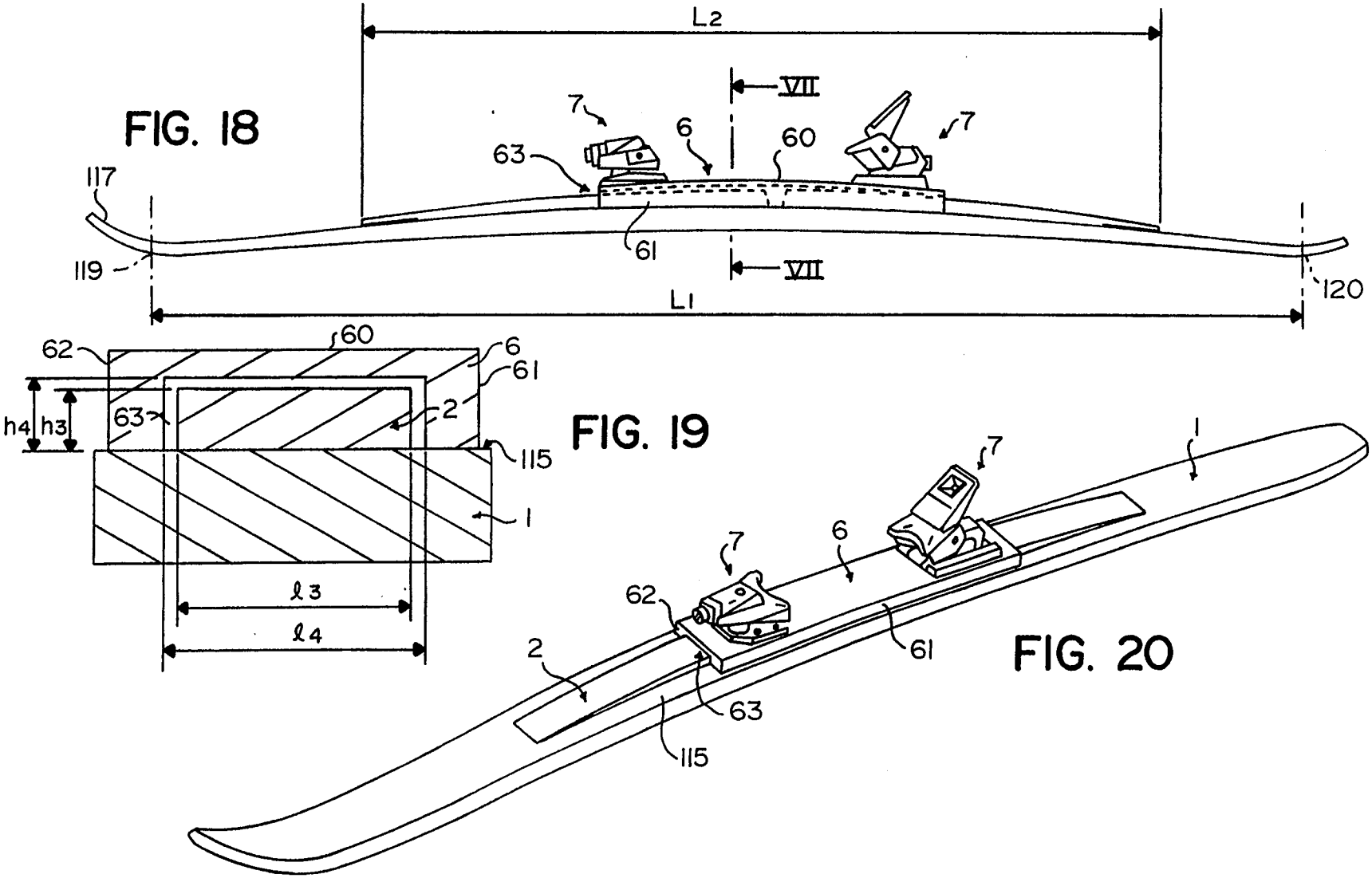
FIG. 18 shows the ski of FIG. 1, on which is located a stirrup enabling assembly of the bindings.
FIG. 19 is a simplified sectional view along VII—VII of FIG. 18.
FIG. 20 is a perspective view of FIG. 18.

FIGS. 18 and 19 show a special improvement adapted for assembly of the bindings on the ski. Thus, according to this improvement, the ski comprises at least one support 6 adapted to receive the bindings 7 for retention of the boot of the skier. The support 6 has the shape of a stirrup having the shape of an inverted "U" and comprises an upper wall 60 extending laterally and downwardly by two lateral walls 61, 62 to constitute a lower housing 63 having the shape of a hollow profile extending longitudinally adapted for the passage of stiffener 2. It must be noted that the dimensions of the housing, both horizontal l4 and vertical h4 are greater than the horizontal dimension l3 and vertical dimension h3 of the stiffener parts to form a space required for releasing the latter, as can be seen in FIG. 19.

According to a characteristic of the invention, the stiffener does not directly receive biases from the skier. Therefore, the support or stirrup 6 is in support only on base 1.

To this end, the lower ends of the lateral walls of the support are connected to the upper surface 115 of base 1. Advantageously, the connection between the support and the base is rigid or flexible and obtained for example by adhesion, welding or any other means, such as mechanical.

Support 6 constitutes the mechanical transmission element and the bias distribution element from the skier on the base.

Figure 21:
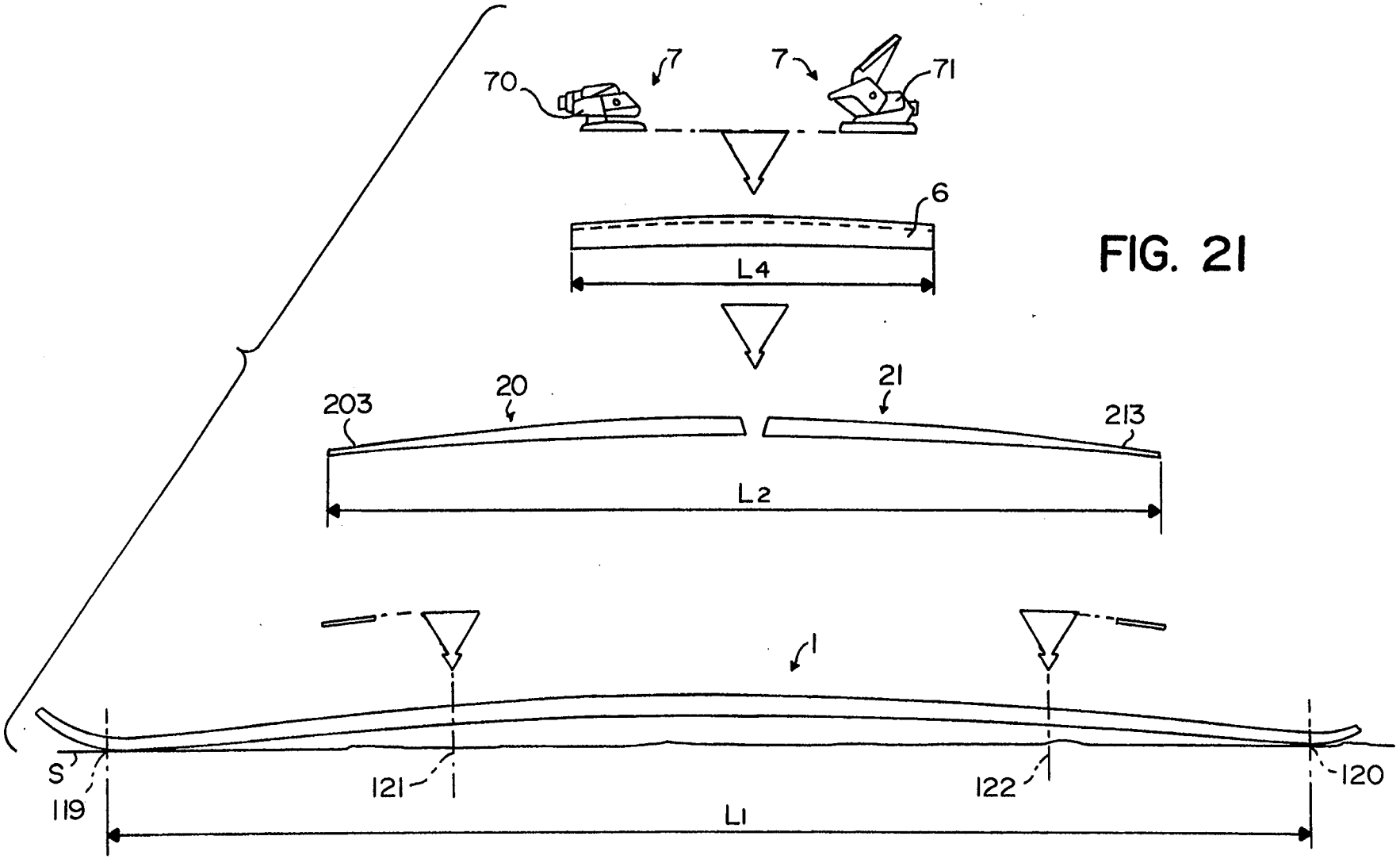
FIG. 21 is a view showing the various elements constituting the ski of FIGS. 18–20 before assembly.

According to an advantageous arrangement as shown in FIG. 21, stiffener 2 has a length L2 less than length L1 of base 1. Thus, the front end 203 of the stiffener is located between the shovel contact point 119 of the base and front end 121 of the normalized zone for assembly of the bindings. Similarly, the rear end 213 of the stiffener is located between the rear contact point 122 and the rear end 120 of the normalized zone for assembly of the bindings. Thus, if base 1 has a length L1 of contact with the snow, stiffener 2 has a length L2 such that L2 is less than L1.

As an example, length L2 of the stiffener is comprised between 50 and 80% of length L1. In addition, the relative longitudinal position of stiffener 2 with respect to the base 1 can be variable.

According to the embodiment of FIG. 21, support 6 receives at the front, front binding 70 and extends rearwardly along a length L4 to beneath the rear binding 71. The rear binding 71 commonly called a heel attachment is itself fixed on the rear part of the support 6.

Figure 22:
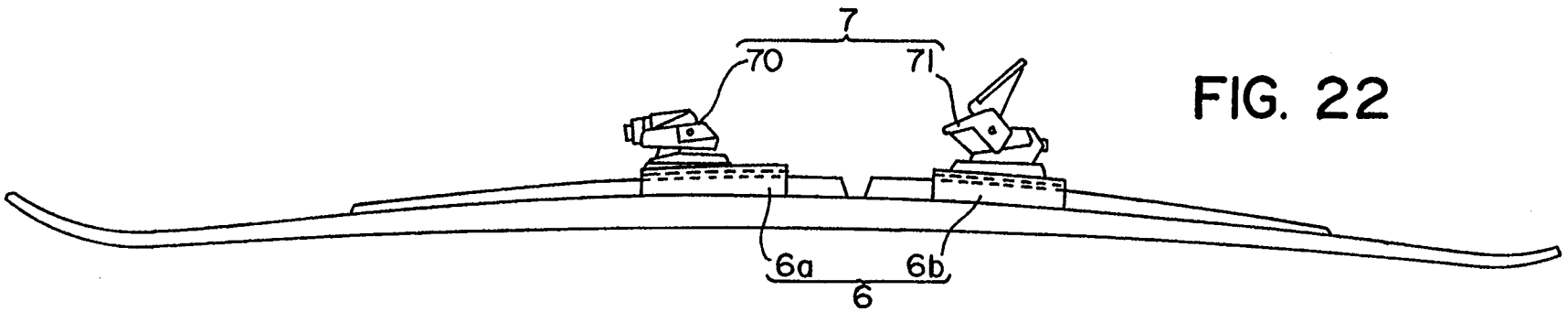
FIG. 22 is a side elevation view of a variation of FIG. 18.

FIG. 22 represents a variation according to which the ski comprises two supports 6 spaced with respect to one another, a first front support **6*a* on which is fixed the front abutment 70 for retention of the boot, and a second support, or rear support 6*b* on which the heel attachment 71** is fixed.

Support 6, **6*a*, 6*b*** can be an injected element made of plastic material or a metallic reinforcement element or a composite element coated or not with a plastic coating, or even a plastic pultruded or extruded element. As an example, we can cite the use of polyamides or styrenes for the composition of the support.

Naturally, support 6, **6*a*, 6*b* can be made of a single piece, or be constituted of different pieces, or even constituted by a part of the corresponding binding 7, 70, 71**.

It must also be noted that the connection between the support and the base can be rigid but also flexible.

Figure 23:
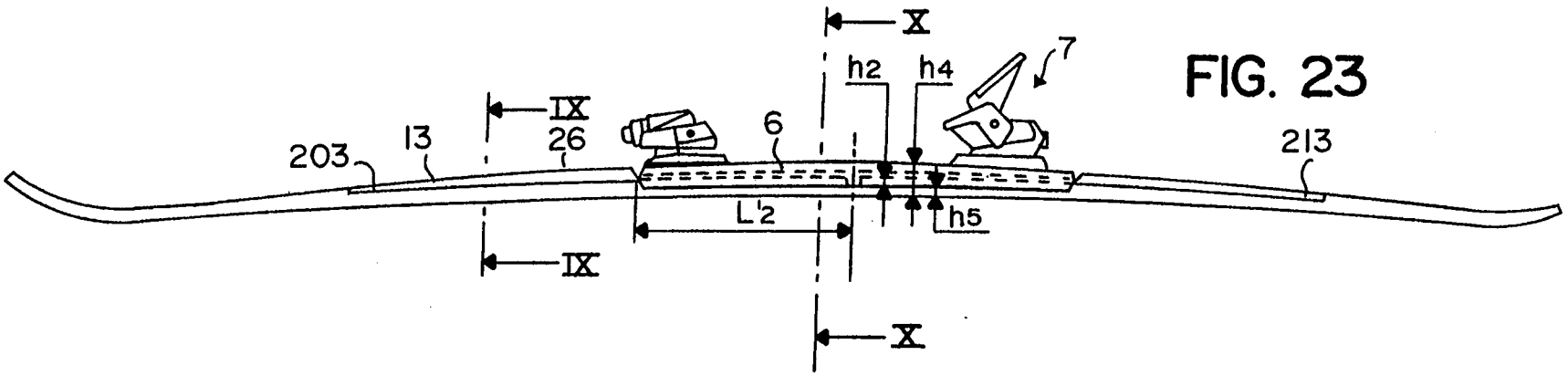
FIG. 23 is another variation of FIG. 18.

FIG. 23 represents another variation in a longitudinal view according to which each part of the stiffener comprises a decrease in its height h2 extending along a reduced length L'2 in the zone of the bindings so as to form a recess enabling reduction of height h4 of the stirrup, and consequently the height of bindings 7 with respect to the snow. In addition, height h5 of the base can also vary to form housings, especially in the zone of the bindings, to enable a better integration of the various elements, base, stiffener, stirrup with respect to each other. In the present case, each end 203, 213 of each part of the stiffener is integrated in a housing 13 obtained in the base.

FIGS. 24 and 25 show, in a transverse section, the special embodiment of the invention of FIG. 22 where the stiffener is constituted by a reinforced section whose shape varies longitudinally. In FIG. 25, the stiffener has the shape of a planar plate in the vicinity of the central part such that its space requirement is reduced to a height h2 and a width 12 less than height h'4 and width l'4 of the recess formed by stirrup 6.

As illustrated in FIG. 24, outside the stirrup zone, the stiffener has the shape of an omega, and has a central rib 26 whose dimensions vary along the ski so as to vary the rigidity specific to each part 20, 21 of the stiffener.

In the present case, the section of central rib 26 reduces progressively towards the front end of the front part of the stiffener and towards the rear end of the rear part.

FIG. 26 shows, in a longitudinal view, the arrangement of parts 20, 21 of stiffener 1 with respect to each other. Stirrup 6 also has the function of avoiding buckling of the stiffener parts during the exertion of substantial flexional forces.

This embodiment has the advantage with respect to those described previously, of being easily obtainable by the TRE technique (Stampable Reinforced Thermoplastic), SMC (Sheet Molding Compound) or by pultrusion, for example. The section can be covered by a superficial layer adapted to protect it and to possibly receive a decor 27.

Figure 27:
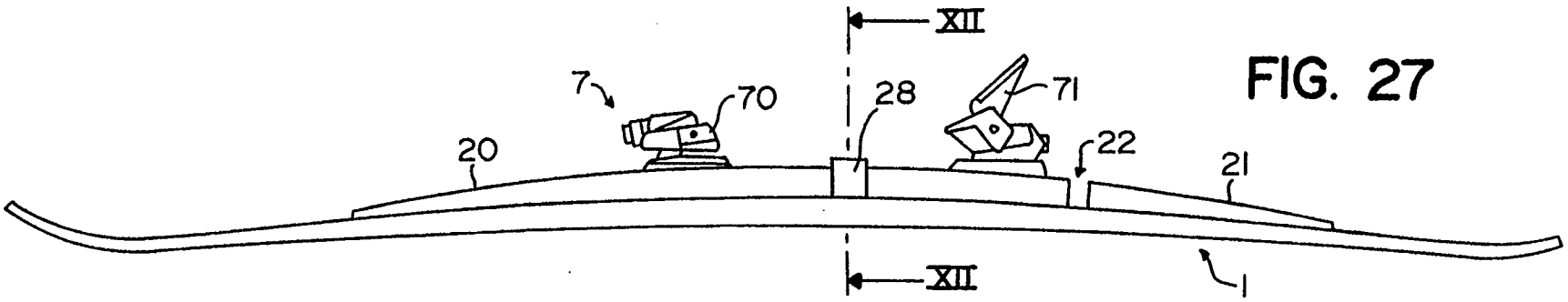
FIG. 27 is a side elevation view of a variation in which the bindings are directly mounted on one of the stiffener parts.

FIG. 27 shows, in a longitudinal view, a variation in which the bindings 7 are directly affixed to one of parts 20, 21 of the stiffener. In the present case, the front part 20 extends in the zone of bindings 7 and the clearance 22 separating the front part 20 from the rear part 21 and is located behind the rear abutment 71. To avoid tearing away of the front part 20, any vertical retention means 28 is provided, enabling translational movements of the stiffener. By vertical retention means, a slide, rail or other means is meant, connecting the stiffener part to the base at one or several points.

Figure 29:
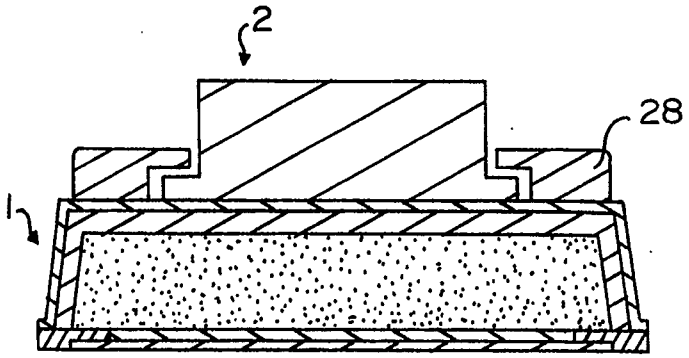
FIG. 29 is a sectional view of a variation of FIG. 28.
Figure 28:
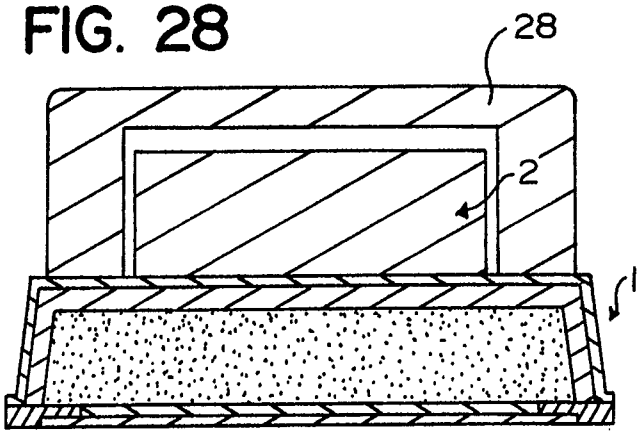
FIG. 28 is a simplified sectional view along XII—XII of FIG. 27.

FIGS. 28 and 29 show, as a non-limiting example, two different assemblies of vertical retention means. In FIG. 28, this is more specifically a stirrup 28 in the shape of an inverted U fixed to the base. In FIG. 29, a slide type of retention means 28 is used.

One can also envision adjusting the distance d or clearance 22 between each part 20, 21 of the stiffener by adjustment means, such as by interposing a non-compressible wedge between each part or even by providing reversible connection means between the stiffener parts and the base in order to be able to modify the distance d of the stiffener parts not represented.

The instant application is based upon French patent application 92.04190 of Apr. 1, 1992, the disclosure of which is hereby expressly incorporated by reference thereto, and the priority of which is hereby claimed.

Naturally, the invention is not limited to the embodiments described and represented as examples herein, but also comprises all technical equivalents and combinations thereof and other variations are also possible without leaving the scope of the invention.

What is claimed is:

1. A ski comprising:

a first lower sub-assembly or base having a front end that is raised to form a shovel; and a second upper sub-assembly or stiffener, wherein the upper sub-assembly comprises two separate parts, connected to the first lower sub-assembly by a connection and wherein the two parts are substantially aligned along a longitudinal axis of the ski, and are spaced from one another by a short distance so as to arrange a clearance when the ski is at rest and the parts come into contact with each other when the ski is biased in flexion under certain functional conditions, so as to increase the stiffness of the ski;

wherein the ski comprises a front contact line and a rear contact line and an assembly zone at which bindings for a ski boot are affixed, the assembly zone including a front end and a rear end;

wherein a front end of the stiffener is located between the front contact line of the ski and the front end of the assembly zone of the bindings; and wherein a rear end of the stiffener is located between the rear contact line of the ski and the rear end of the assembly zone of the bindings.

2. A ski as defined by claim 1, wherein the stiffener has a length (L2) less than or equal to a length (L1) of a surface of the base in contact with a running surface such as snow.

3. A ski as defined by claim 2, wherein the length (L2) of the stiffener is comprised within 50 to 80% of the length (L1) of the surface of the base in contact with the running surface.

4. A ski as defined by claim 1, wherein the two parts of the stiffener are symmetrical with respect to median vertical axis of the ski.

5. A ski as defined by claim 1, wherein the height of each stiffener part varies along the ski.

6. A ski as defined by claim 1, wherein the base is a beam constituted by a core located between two reinforcements, a first upper reinforcement and a second lower reinforcement, and comprises a sliding layer laterally comprising two lateral metallic running edges, said upper reinforcement being covered at least partially by a superficial layer.

7. A ski as defined by claim 1, wherein each part of the stiffener comprises a section constituted at least one reinforcement layer and whose shape varies along the ski.

8. A ski as defined by claim 1, wherein a front part of the stiffener is only partially connected to the base by a front end along a first predeterminate length.

9. A ski as defined by claim 8, wherein the partial connection of the front part of the stiffener is rigid.

10. A ski as defined by claim 8, wherein a rear part of the stiffener is only partially connected to the base by a rear end along a second predeterminate length.

11. A ski as defined by claim 1, wherein a rear part of the stiffener is only partially connected to the base by a rear end along a second predeterminate length.

12. A ski as defined by claim 11, wherein the partial connection of the rear part of the stiffener is rigid.

13. A ski as defined by claim 1, wherein the ski comprises at least one support or stirrup connected to the base and adapted to receive the bindings for maintaining a boot on the ski.

14. A ski as defined by claim 1, wherein the parts of the stiffener cooperate with each other when the ski is biased in flexion so as to increase the stiffness of the ski in a non-linear relationship with respect to an increase in biasing of the ski in flexion.

15. A ski as defined by claim 1, wherein the stiffener is connected to the base by a flexible connection.

16. A ski as defined by claim 1, wherein the stiffener is connected to the base by a rigid connection that extends partially along the length of each of the two parts of the stiffener.

17. A ski as defined by claim 1, wherein the stiffener is connected to the base by a flexible connection and by a rigid connection that extends partially along the length of each of the two parts of the stiffener.

18. A ski comprising:

a first lower sub-assembly or base having a front end that is raised to form a shovel; and a second upper sub-assembly or stiffener, wherein the upper sub-assembly comprises two separate parts, connected to the first lower sub-assembly by a connection and wherein the two parts are substantially aligned along a longitudinal axis of the ski, and are spaced from one another by a short distance when the ski is at rest and the parts cooperate with each other when the ski is biased in flexion under certain functional conditions, so as to increase the stiffness of the ski;

wherein the ski comprises a front contact line and a rear contact line and an assembly zone at which bindings for a ski boot are affixed, the assembly zone including a front end and a rear end;

wherein a front end of the stiffener is located between the front contact line of the ski and the front end of the assembly zone of the bindings;

wherein a rear end of the stiffener is located between the rear contact line of the ski and the rear end of the assembly zone of the bindings; and wherein each part of the stiffener is a beam constituted by a core located between two reinforcements, a first upper reinforcement and a second lower reinforcement, said upper reinforcement being covered by a superficial layer.

19. A ski comprising:

a first lower sub-assembly or base having a front end that is raised to form a shovel; and a second upper sub-assembly or stiffener, wherein the upper sub-assembly comprises two separate parts, connected to the first lower sub-assembly by a connection and wherein the two parts are substantially aligned along a longitudinal axis of the ski, and are spaced from one another by a short distance when the ski is at rest and the parts cooperate with each other when the ski is biased in flexion under certain functional conditions, so as to increase the stiffness of the ski;

wherein the ski comprises a front contact line and a rear contact line and an assembly zone at which bindings for a ski boot are affixed, the assembly zone including a front end and a rear end;

wherein a front end of the stiffener is located between the front contact line of the ski and the front end of the assembly zone of the bindings;

wherein a rear end of the stiffener is located between the rear contact line of the ski and the rear end of the assembly zone of the bindings;

wherein a front part of the stiffener is only partially connected to the base by a front end along a predeterminate length; and wherein the connection of the front part of the stiffener is flexible.

20. A ski comprising:

a first lower sub-assembly or base having a front end that is raised to form a shovel; and a second upper sub-assembly or stiffener, wherein the upper sub-assembly comprises two separate parts, connected to the first lower sub-assembly by a connection and wherein the two parts are substantially aligned along a longitudinal axis of the ski, and are spaced from one another by a short distance when the ski is at rest and the parts cooperate with each other when the ski is biased in flexion under certain functional conditions, so as to increase the stiffness of the ski;

wherein the ski comprises a front contact line and a rear contact line and an assembly zone at which bindings for a ski boot are affixed, the assembly zone including a front end and a rear end;

wherein a front end of the stiffener is located between the front contact line of the ski and the front end of the assembly zone of the bindings;

wherein a rear end of the stiffener is located between the rear contact line of the ski and the rear end of the assembly zone of the bindings; and wherein both parts of the stiffener are connected to the base along the entire length of the stiffener by a flexible connection.

21. A ski comprising:

a first lower sub-assembly or base having a front end that is raised to form a shovel; and a second upper sub-assembly or stiffener, wherein the upper sub-assembly comprises two separate parts, connected to the first lower sub-assembly by a connection and wherein the two parts are substantially aligned along a longitudinal axis of the ski, and are spaced from one another by a short distance when the ski is at rest and the parts cooperate with each other when the ski is biased in flexion under certain functional conditions, so as to increase the stiffness of the ski;

wherein the ski comprises a front contact line and a rear contact line and an assembly zone at which bindings for a ski boot are affixed, the assembly zone including a front end and a rear end;

wherein a front end of the stiffener is located between the front contact line of the ski and the front end of the assembly zone of the bindings;

wherein a rear end of the stiffener is located between the rear contact line of the ski and the rear end of the assembly zone of the bindings;

wherein a rear part of the stiffener is only partially connected to the base by a rear end along a predeterminate length; and wherein the partial connection of the rear part of the stiffener is flexible.

22. A ski extending along a longitudinal axis, said ski comprising:

a base having a front end that is raised to form a shovel, said shovel ending at a ski tip; and a stiffener comprising a front stiffener portion and a rear stiffener portion, each of said front stiffener portion and said rear stiffener portion being affixed onto an upper portion of said base, said front stiffener portion and said rear stiffener portion being aligned along said longitudinal axis, said front stiffener portion and said rear stiffener portion having respective surfaces that are spaced apart in a rest position of said ski, said front stiffener portion and said rear stiffener portion comprising means for increasing stiffness in response to biasing of said ski in flexion as said respective spaced apart surfaces of said front stiffener portion and said rear stiffener portion direct opposing forces with respect to each other during said flexion of said ski;

wherein said ski comprises a front contact line and a rear contact line and an assembly zone at which bindings for a ski boot are affixed, the assembly zone including a front end and a rear end;

wherein a front end of said front stiffener portion is located between said front contact line of the ski and said front end of the assembly zone of the bindings;

wherein a rear end of said rear stiffener portion is located between said rear contact line of the ski and said rear end of the assembly zone of the bindings; and wherein said ski further comprises a flexible connection between said front stiffener portion and said base and a flexible connection between said rear stiffener portion and said base.

23. A ski as defined by claim 22, wherein each of said front stiffener portion and said rear stiffener portion has a predeterminate length and wherein each said flexible connection extends generally the entire predeterminate length of each of said front stiffener portion and said rear stiffener portion.

24. A ski as defined by claim 22, wherein each of said front stiffener portion and said rear stiffener portion has a predeterminate length and wherein each said flexible connection extends partially along said predeterminate length of each of said front stiffener portion and said rear stiffener portion.

25. A ski comprising:

a first lower slightly arched sub-assembly or base having a front end that is raised to form a shovel; and a second upper sub-assembly or stiffener, wherein the upper sub-assembly comprises two separate parts, connected to the first lower sub-assembly by a connection and wherein the two parts are substantially aligned along a longitudinal axis of the ski, and are spaced from one another by a free space occupied at least partially by a shock absorption device in a state which does not vary the arch of the first sub-assembly when the ski is at rest and the parts cooperate with each other to compress progressively the shock absorption device when the ski is biased in flexion under certain functional conditions;

wherein the ski comprises a front contact line and a rear contact line and an assembly zone at which bindings for a ski boot are affixed, the assembly zone including a front end and a rear end;

wherein a front end of the stiffener is located between the front contact line of the ski and the front end of the assembly zone of the bindings;

wherein a rear end of the stiffener is located between the rear contact line of the ski and the rear end of the assembly zone of the bindings; and wherein the stiffener is connected to the base by a flexible connection.

26. A ski as defined by claim 25, wherein the stiffener has a length (L2) less than or equal to a length (L1) of a surface of the base in contact with a running surface such as snow.

27. A ski as defined by claim 26, wherein the length (L2) of the stiffener is comprised between 50% and 80% of the length (L1) of the surface of the base in contact with the running surface.

28. A ski as defined by claim 25, wherein the height of each stiffener part varies along the ski.

29. A ski as defined by claim 25, wherein the base is a beam constituted by a core located between two reinforcements, a first upper reinforcement and a second lower reinforcement, and comprises a sliding layer laterally comprising two lateral metallic running edges, said upper reinforcement being covered at least partially by a superficial layer.

30. A ski as defined by claim 25, wherein a front part of the stiffener is only partially connected to the base by a front end along a first predetermined length.

31. A ski as defined by claim 30, wherein a rear part of the stiffener is only partially connected to the base by a rear end along a second predetermined length.

32. A ski as defined by claim 30, wherein the partial connection of the front part of the stiffener is rigid.

33. A ski as defined by claim 25, wherein a rear part of the stiffener is only partially connected to the base by a rear end along a second predetermined length.

34. A ski as defined by claim 33, wherein the partial connection of the rear part of the stiffener is rigid.

35. A ski as defined by claim 25, wherein the ski comprises at least one support or stirrup connected to the base and adapted to receive the bindings for maintaining a boot on the ski.

36. A ski as defined by claim 25, wherein the parts of the stiffener cooperate with each other when the ski is biased in flexion so as to increase the stiffness of the ski in a non-linear relationship with respect to an increase in biasing of the ski in flexion.

37. A ski as defined by claim 25, wherein the stiffener is connected to the base by a rigid connection that extends partially along the length of each of the two parts of the stiffener.

38. A ski as defined by claim 25, wherein the stiffener is connected to the base by a flexible connection and by a rigid connection that extends partially along the length of each of the two parts of the stiffener.

39. A ski comprising:

a first lower sub-assembly or base having a front end that is raised to form a shovel; and a second upper sub-assembly or stiffener, wherein the upper sub-assembly comprises two separate parts, connected to the first lower sub-assembly by a connection and wherein the two parts are substantially aligned along a longitudinal axis of the ski, and are spaced from one another by a free space occupied by a pad connecting a first part of the upper surface of one of said parts to a second part of the lower surface of the other part when the ski is at rest and the parts cooperate with each other to shear said pad when the ski is biased in flexion under certain functional conditions;

wherein the ski comprises a front contact line and a rear contact line and an assembly zone at which bindings for a ski boot are affixed, the assembly zone including a front end and a rear end;

wherein a front end of the stiffener is located between the front contact line of the ski and the front end of the assembly zone of the bindings; and wherein a rear end of the stiffener is located between the rear contact line of the ski and the rear end of the assembly zone of the bindings.

40. A ski as defined by claim 39, wherein the stiffener has a length (L2) less than or equal to a length (L1) of a surface of the base in contact with a running surface such as snow.

41. A ski as defined by claim 40, wherein the length (L2) of the stiffener is comprised between 50% and 80% of the length (L1) of the surface of the base in contact with the running surface.

42. A ski as defined by claim 39, wherein the height of each stiffener part varies along the ski.

43. A ski as defined by claim 39, wherein the base is a beam constituted by a core located between two reinforcements, a first upper reinforcement and a second lower reinforcement, and comprises a sliding layer laterally comprising two lateral metallic running edges, said upper reinforcement being covered at least partially by a superficial layer.

44. A ski as defined by claim 39, wherein a front part of the stiffener is only partially connected to the base by a front end along a first predetermined length.

45. A ski as defined by claim 44, wherein a rear part of the stiffener is only partially connected to the base by a rear end along a second predetermined length.

46. A ski as defined by claim 44, wherein the partial connection of the front part of the stiffener is rigid.

47. A ski as defined by claim 39, wherein a rear part of the stiffener is only partially connected to the base by a rear end along a second predetermined length.

48. A ski as defined by claim 47, wherein the partial connection of the rear part of the stiffener is rigid.

49. A ski as defined by claim 39, wherein the ski comprises at least one support or stirrup connected to the base and adapted to receive the bindings for maintaining a boot on the ski.

50. A ski as defined by claim 39, wherein the parts of the stiffener cooperate with each other when the ski is biased in flexion so as to increase the stiffness of the ski in a non-linear relationship with respect to an increase in biasing of the ski in flexion.

51. A ski as defined by claim 39, wherein the stiffener is connected to the base by a flexible connection.

52. A ski as defined by claim 39, wherein the stiffener is connected to the base by a rigid connection that extends partially along the length of each of the two parts of the stiffener.

53. A ski as defined by claim 39, wherein the stiffener is connected to the base by a flexible connection and by a rigid connection that extends partially along the length of each of the two parts of the stiffener.

54. A ski comprising:

a first lower slightly arched sub-assembly or base having a front end that is raised to form a shovel; and a second upper sub-assembly or stiffener, wherein the upper sub-assembly comprises two separate parts, connected to the first lower sub-assembly by a connection and wherein the two parts are substantially aligned along a longitudinal axis of the ski, and are spaced from one another by a free space occupied at least partially by a longitudinal energizing system in a state which does not vary the arch of the first sub-assembly when the ski is at rest and the parts cooperate with each other to compress progressively said longitudinal energizing system when the ski is biased in flexion under certain functional conditions, so as to increase the stiffness of the ski;

wherein the ski comprises a front contact line and a rear contact line and an assembly zone at which bindings for a ski boot are affixed, the assembly zone including a front end and a rear end;

wherein a front end of the stiffener is located between the front contact line of the ski and the front end of the assembly zone of the bindings;

wherein a rear end of the stiffener is located between the rear contact line of the ski and the rear end of the assembly zone of the bindings; and wherein the stiffener is connected to the base by a flexible connection.

55. A ski as defined by claim 54, wherein the stiffener has a length (L2) less than or equal to a length (L1) of a surface of the base in contact with a running surface such as snow.

56. A ski as defined by claim 55, wherein the length (L2) of the stiffener is comprised between 50% and 80% of the length (L1) of the surface of the base in contact with the running surface.

57. A ski as defined by claim 54, wherein the height of each stiffener part varies along the ski.

58. A ski as defined by claim 54, wherein the base is a beam constituted by a core located between two reinforcements, a first upper reinforcement and a second lower reinforcement, and comprises a sliding layer laterally comprising two lateral metallic running edges, said upper reinforcement being covered at least partially by a superficial layer.

59. A ski as defined by claim 54, wherein a front part of the stiffener is only partially connected to the base by a front end along a first predetermined length.

60. A ski as defined by claim 59, wherein a rear part of the stiffener is only partially connected to the base by a rear end along a second predetermined length.

61. A ski as defined by claim 59, wherein the partial connection of the front part of the stiffener is rigid.

62. A ski as defined by claim 54, wherein a rear part of the stiffener is only partially connected to the base by a rear end along a second predetermined length.

63. A ski as defined by claim 62, wherein the partial connection of the rear part of the stiffener is rigid.

64. A ski as defined by claim 54, wherein the ski comprises at least one support or stirrup connected to the base and adapted to receive the bindings for maintaining a boot on the ski.

65. A ski as defined by claim 54, wherein the parts of the stiffener cooperate with each other when the ski is biased in flexion so as to increase the stiffness of the ski in a non-linear relationship with respect to an increase in biasing of the ski in flexion.

66. A ski as defined by claim 54, wherein the stiffener is connected to the base by a rigid connection that extends partially along the length of each of the two parts of the stiffener.

67. A ski as defined by claim 54, wherein the stiffener is connected to the base by a flexible connection and by a rigid connection that extends partially along the length of each of the two parts of the stiffener.

* * * * *